US007162771B2

(12) United States Patent
Grosze et al.

(10) Patent No.: US 7,162,771 B2
(45) Date of Patent: Jan. 16, 2007

(54) FLOOR CLEANING MACHINE WITH DUST CONTROL APPARATUS AND ASSOCIATE METHOD OF USE

(75) Inventors: Scott F. Grosze, Fayetteville, AR (US); John Stephen Petty, Fayetteville, AR (US); John L. Obenshain, Rogers, AR (US)

(73) Assignee: Alto U.S. Inc., Springdale, AR (US)

( * ) Notice: Subject to any disclaimer, the term of this patent is extended or adjusted under 35 U.S.C. 154(b) by 527 days.

(21) Appl. No.: 10/249,741

(22) Filed: May 5, 2003

(65) Prior Publication Data

US 2004/0221417 A1 Nov. 11, 2004

(51) Int. Cl.
*A47L 11/20* (2006.01)

(52) U.S. Cl. ..... 15/385; 15/347; 15/349; 15/246.2

(58) Field of Classification Search ..... 15/385, 15/49.1, 98, 325, 347, 349, 409, 246.2; 451/453, 451/119, 456
See application file for complete search history.

(56) References Cited

U.S. PATENT DOCUMENTS

| | | | | |
|---|---|---|---|---|
| 2,415,372 A | | 2/1947 | Salt et al. | |
| 2,663,893 A | * | 12/1953 | Percy | 15/385 |
| 3,882,644 A | | 5/1975 | Cusumano | |
| 4,059,863 A | | 11/1977 | Deuchar et al. | |
| 4,178,654 A | | 12/1979 | Mitchell | |
| 4,608,727 A | | 9/1986 | Schwab | |
| 4,631,775 A | * | 12/1986 | Palmer et al. | 15/385 |
| 4,720,886 A | | 1/1988 | McLeod et al. | |
| 4,731,956 A | | 3/1988 | Wood | |
| 4,805,258 A | | 2/1989 | Sitarski et al. | |
| 4,910,824 A | | 3/1990 | Nagayama et al. | |
| 4,939,811 A | | 7/1990 | Matunaga et al. | |
| 5,098,506 A | | 3/1992 | Brown et al. | |
| 5,125,190 A | * | 6/1992 | Buser et al. | 451/456 |
| 5,203,046 A | | 4/1993 | Shaw | |
| 5,392,492 A | | 2/1995 | Fassauer | |
| 5,522,114 A | * | 6/1996 | Allison | 15/385 |
| 5,608,939 A | * | 3/1997 | Waldhauser et al. | 15/385 |

(Continued)

OTHER PUBLICATIONS

Pioneer Eclipse®, Speed Star™ Propane Burnisher with Vacuum Operator's Manual, Jul. 28, 2000.

(Continued)

*Primary Examiner*—Theresa T. Snider
(74) *Attorney, Agent, or Firm*—Blackwell Sanders Peper Martin LLP; Lawrence E. Evans

(57) ABSTRACT

A floor cleaning machine with dust control apparatus can assist in capturing dust created as a by-product during normal operations. The dust control apparatus is particularly applicable to propane-powered burnishers that use rotating pads to remove built up wax from hard surface floors. A floating scoop is attached to a floating hoop assembly to direct dust away from the rotating pad. The scoop is located tangentially to the housing that surrounds the rotating pad. An inlet to the housing facilitates airflow through the housing to pick up dust, which exits through the scoop. A containment canister with removable filter is in communication with the scoop. The air and entrained particulate (dust) swirls around the filter in a circular flow path to help separate the particulate from the air. The filtered air exits the canister and returns to the atmosphere.

22 Claims, 4 Drawing Sheets

U.S. PATENT DOCUMENTS

| | | | | |
|---|---|---|---|---|
| 5,951,388 | A | 9/1999 | Parsons | |
| 5,974,626 | A | 11/1999 | Wood et al. | |
| 6,224,471 | B1 * | 5/2001 | Clowers et al. | 451/359 |
| 6,240,596 | B1 * | 6/2001 | Kiern | 15/385 |
| 2005/0060836 | A1 * | 3/2005 | Nielsen et al. | 15/385 |

OTHER PUBLICATIONS

Pioneer Eclipse®, Revolution™ Operator's Manual, Apr. 6, 2000.
Clarke® American Sanders™, FloorCrafter™ Belt Sander Brochure, 2001.
Clarke® American Sanders™, EZ-8 Sander Brochure, 2001.
Clarke® American Sanders™, Power Booster for Floor Sanders Brochure, 2001.
Clarke® American Sanders™, Super 7R Wood Floor Edger Brochure, 2001.
ALTO®, B-2+ Electric Wood Floor Edging Machine Brochure, 1998.
Clarke® American Sanders™, Super E Wood Floor Combination Edger Brochure, 2001.
ALTO®, 3 DS Electric Fine Finish Floor Sander Brochure, 1999.
ALTO®, 3 DS Electric Fine Finish Floor Sander Brochure, 1998.
ALTO®, Sander 16 & Sander 16dc Brochure, 1998.
ALTO®, American 8 & American 12 Drum Type Professional Wood Floor Sanders Brochure, 1998.
ALTO®, Classic 8 Belt Type Wood Floor Sander Brochure, 1999.
ALTO®, EZ-8 Sander Brochure, 1998.
ALTO®, Super E Wood Floor Extension Edger Brochure, 1999.
ALTO®, Super 7R Wood Floor Edger Brochure, 1998.
Alto® Clarke-American Sanders, Professional Dust Control Sanding System Brochure, 2001.
ALTO®, OBS 18 & OBS 18dc Orbital Floor Sander Brochure, 1998.

* cited by examiner

FLOOR CLEANING MACHINE WITH DUST CONTROL APPARATUS AND ASSOCIATE METHOD OF USE

BACKGROUND OF INVENTION

Floor cleaning machines often create dust as a by-product of normal operations. For example, burnishers are used to remove one or more layers of wax or other coatings from a hard surface floor, such as composition tile. A rotating pad in the burnisher is in contact with the built-up wax on the floor. As the pad rotates, one or more layers of wax are removed from the floor, restoring the shine to the surface. Dust is normally created as a by-product of this wax removal process. The dust can be troublesome as it settles on almost everything in the surrounding environment. For example, in a grocery store, the dust accumulates on canned goods, bottles, produce, and shelving. In an office, the dust accumulates on furniture, bookshelves, word processing equipment, and other office equipment. In a warehouse, the dust accumulates on boxes, racks and other products. Cleaning personnel spend extra time dusting after a floor has been burnished with prior art burnishers that do not have any kind of dust control apparatus. The industry has recognized a need for burnishers with some type of dust control apparatus.

Pioneer Eclipse® of Sparta, N.C. (www.pioneer-eclipse.com) sells at least two burnishers with dust control apparatus. One model with dust control apparatus is called the Speed Star™ and the other is called the Revolution™.

The Speed Star™ burnisher from Pioneer Eclipse® attempts to collect dust in a dust bag. A non-floating scoop is rigidly attached to the underside of the pad housing above the pad driver and the pad. The scoop is curved and feeds up through the pad housing to a throat that attaches to the dust bag. The dust bag can be removed from the throat to be emptied. A propane-powered engine drives a belt, which causes the pad to rotate. The belt connects to a drive pulley. A pulley cover isolates the belt and the drive pulley. In other words, there is no inlet into the pad housing to facilitate airflow through the scoop and throat and into the dust bag. As a result, there is only a modest amount of dust collected in the cloth dust bag.

The Revolution™ burnisher from Pioneer Eclipse® attempts to collect dust in a removable filter, instead of a cloth dust bag. A non-floating scoop is rigidly attached to the underside of the pad housing above the pad driver and the pad. The scoop is curved and feeds up through the pad housing into a plastic throat, which feeds into a filter housing. The filter can be removed from the filter housing for cleaning or to be replaced. A propane-powered engine drives a belt, which causes the pad to rotate. The belt connects to a drive pulley on top of the pad housing. In other words, there is no inlet into the pad housing to facilitate airflow through the scoop and the throat into the filter housing. As a result, there is only a modest amount of dust collected in the filter and the filter housing. There is still a need for a floor cleaning machine that does a better job of dust control.

Dust control is also a concern in the design and manufacture of sanders for hardwood floors. The Information Disclosure Statement filed concurrently herewith includes an advertising brochure from Clarke American Sanders entitled "Dust Control Floor Sanders." The brochure has a picture of an orbital sander showing the vacuum fan and a disposable paper filter/collection bag. The apparatus includes a floating skirt to contain dust. The inlet for the dust is positioned on the top of the deck of the sander, not on the side of the sander. This Brochure also pictures a disk sander with a vacuum adapter that connects to any vacuum system with an 1Â½ inch diameter vacuum hose. This sander also has a floating skirt that directs the dust to a pick-up chamber. Again, the inlet or pick-up chamber for the dust is positioned on the top of the deck and not on the side of the sander. Also included in the Information Disclosure Statement, is brochure from Clarke American Sanders entitled "Professional Dust Control Sanding System." This Brochure shows a disk sander with vacuum adapter connected to a portable vacuum cleaner. Again, the inlet for the dust is on the top of the deck of the sander and not on the side of the sander. There still is a need for improved dust control systems in floor cleaning machines.

SUMMARY OF INVENTION

The present invention is a floor cleaning machine with an improved dust control apparatus. This dust control apparatus can also be sold separately as an after-market addition for existing floor cleaning machines that lack any dust control apparatus, or for floor cleaning machines that have inadequate dust control capabilities. This invention is particularly suited for use with propane-powered burnishers that create dust as a by-product during normal operations.

Floor cleaning machines typically have a rotating circular pad in contact with the floor. These pads sometimes travel at relatively high rates of speed, i.e., about 2,000 rpm or more. These pads wear over time and the height of the pad may vary by Â½ inch or more during the useful life of the pad. Because the pads wear down over time and for other reasons, some floor cleaning machines have a floating hoop assembly that is sometimes referred to in the industry as a skirt. The floating hoop assembly helps to contain dust during operation of the machine. The present invention includes a floating scoop attached to the floating hoop assembly so the hoop assembly and the scoop will move up and down in tandem over irregularities in the floor and as the pad wears.

The floating scoop directs at least a portion of the dust away from the pad. The scoop is in communication with a throat and a circular canister. In one embodiment, a removable filter is placed in the circular canister. The dust moves through the scoop, the throat, and into the circular canister, where it swirls in a circular motion around the filter. The circular canister and the filter act as a separator to assist in removal of the entrained dust from the air.

A housing surrounds the pad and also helps to contain the dust. The housing includes a generally vertical sidewall around the outer circumference of the pad. A drive belt passes through an opening in the sidewall of the housing to rotate the pad driver, which is connected to the pad. This opening operates as an air inlet during operation of the floor cleaning machine of the present invention. Unlike the Speed StarÂ□ and the RevolutionÂ□ from Pioneer EclipseÂ®, ambient air passes through this inlet and becomes entrained with particulate (dust). This air with entrained particulate (dust) exits the housing through the scoop on the way to the circular canister. This upper flow path allows a constant stream of air to enter the housing, pick-up dust, exit the housing with the dust and move to the canister where the dust is separated from the air.

The scoop acts as an outlet for the housing. The scoop is in communication with an upper flow path of entrained particulate (dust) and air. The upper flow path is generally defined by the housing and the pad driver. The scoop is also in communication with a circumferential flow path of entrained particulate (dust) and air. The circumferential flow passageway is generally defined by an outer edge of the pad and the floating hoop assembly.

These are merely illustrative aspects of the present invention and should not be deemed an all-inclusive listing of the innumerable aspects associated with the present invention. These and other aspects will become apparent to those skilled in the art, in view of the following disclosure and accompanying drawings.

BRIEF DESCRIPTION OF DRAWINGS

For a better understanding of the present invention, reference may be made to the accompanying drawings in which.

DETAILED DESCRIPTION

Figure 1:
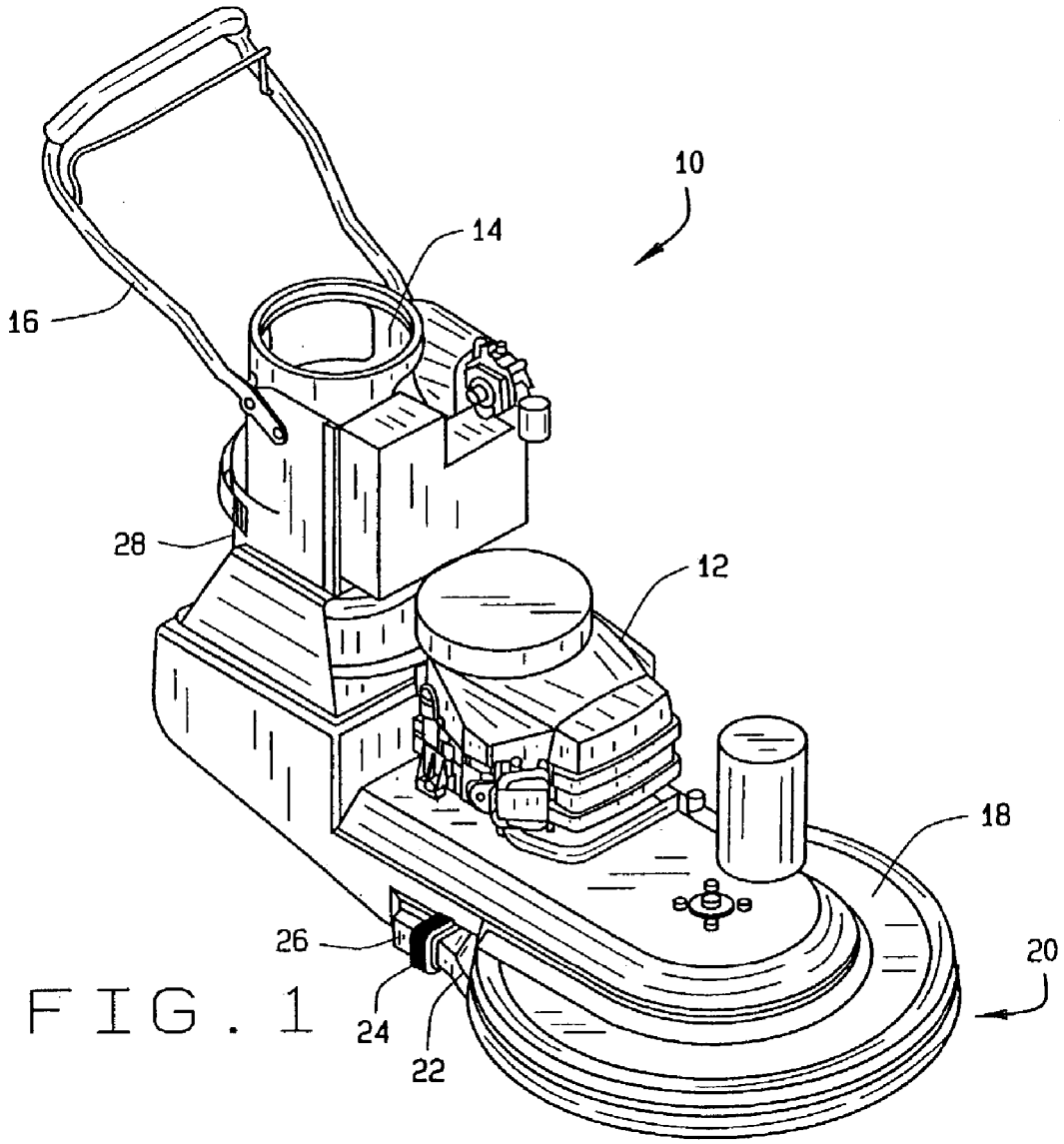
FIG. 1 is a perspective view of a floor cleaning machine.

FIG. 1 is a perspective view of a floor cleaning machine generally identified by the numeral 10. The invention is applicable to various types of floor cleaning machines, but is particularly suited for burnishers. The floor cleaning machine 10 is a propane-powered burnisher.

The floor cleaning machine 10 has a propane-powered engine 12. The propane fuel is stored in a propane tank 14. The operator grips the handle 16 to control the direction of the machine. Rotation of the pad 52, better seen in FIG. 5, pulls the machine forward because the pad 52 is slightly inclined, as known to those skilled in the art.

A housing 18 surrounds the pad 52, not seen in this view. A floating hoop assembly, generally identified by the numeral 20 is positioned about the outer circumference of the housing 18. The floating hoop assembly 20 moves up and down over irregularities in the floor and also accommodates wear in the pad 52. The height of the pad 52 may vary by as much as Å¼ inch due to wear.

A floating scoop 22 is attached to the floating hoop assembly 20 so they both float up and down in tandem. A flexible boot 24 connects the scoop to a throat 26. The throat 26 is in communication with the containment canister 28. Entrained particles (dust) are captured by the housing 18 and the floating hoop assembly 20. The entrained particles (dust) pass through the floating scoop assembly 22, the flexible boot 24, and the throat 26 and then swirl around in the circular containment canister 28 where they are separated from the air stream.

Figure 2:
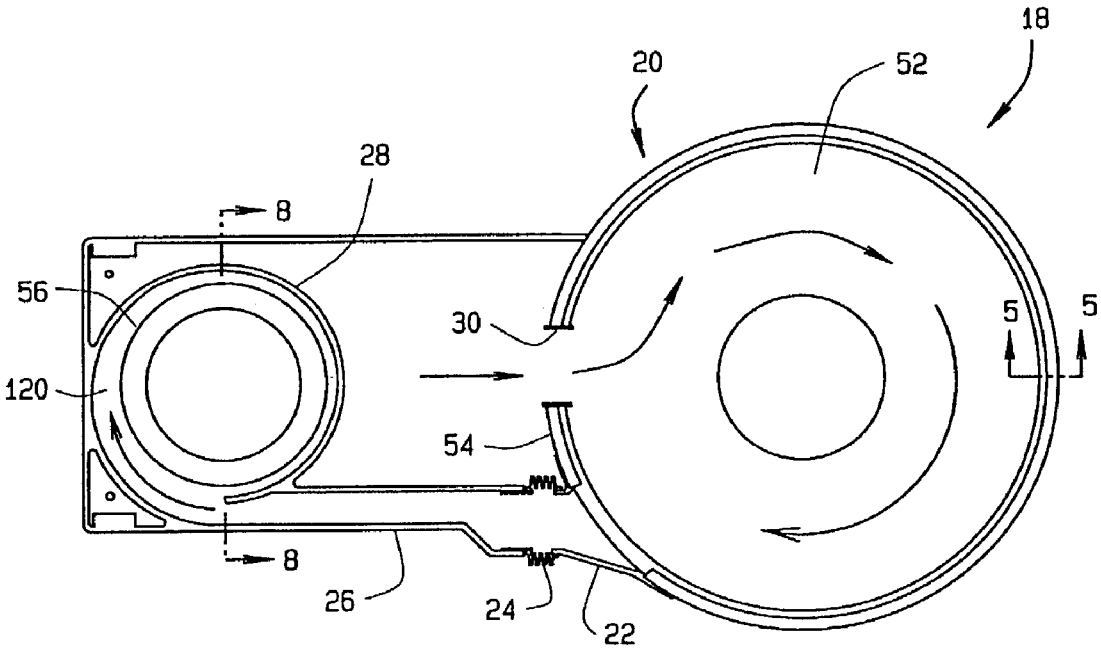
FIG. 2 is a section view of the bottom portion of the floor cleaning machine of FIG. 1 showing the air flow path from the housing to the containment canister.

FIG. 2 is a section view of the bottom portion of the floor cleaning machine of FIG. 1 showing the airflow path from the housing 18 to the containment canister 28. The pad 52 rotates clockwise as indicated by the arrows. An air inlet 30 is formed in the sidewall 54 of the housing 18. (The sidewall and housing 18 are better seen in FIG. 5.) Ambient air from the atmosphere surrounding the floor cleaning machine 10 enters the housing 18 through the inlet 30. The rotation of the pad 52 causes the air to spin in the housing 18 in a clockwise fashion and to pick up the dust. The entrained particles (dust) exit the housing 18 through the floating scoop 22. The floating scoop 22 is connected by a flexible boot 24 to a throat 26. The floating scoop 22 is arranged generally tangentially to the circular pad 52. The combination of the floating scoop 22, the flexible boot 24, and the throat 26, create an air conduit in the preferred embodiment, however, virtually any type of air conduit that removes air and entrained particles (dust) from the housing 18 will suffice. The throat 26 provides a venturi-effect in that the throat 26 causes an increase in the velocity and a corresponding decrease in pressure for creating suction. This is an advantage in removing entrained particles (dust) from the housing 18 without an additional pump or vacuum, which is present in other prior art devices.

The container canister 28 is circular and holds a removable filter 56. The throat 26 is arranged generally tangentially to the containment canister 28. The floating scoop 22, the throat 26 and the containment canister 28 are all in communication with the housing 18. Air enters the housing 18 through the inlet 30, circulates in the housing 18 and becomes entrained with particles (dust). The air stream with entrained particles (dust) exits the housing 18 through the floating scoop 22, passes through the throat 26 and into the containment canister 28. The air stream with entrained particles (dust) circulates in a circular clockwise motion about the removable filter 56 as shown by the arrow in the drawing. The swirling motion around the removable filter 56 facilitates separation of the air and the particles (dust) as will be discussed in greater detail concerning FIG. 8.

Figure 3:
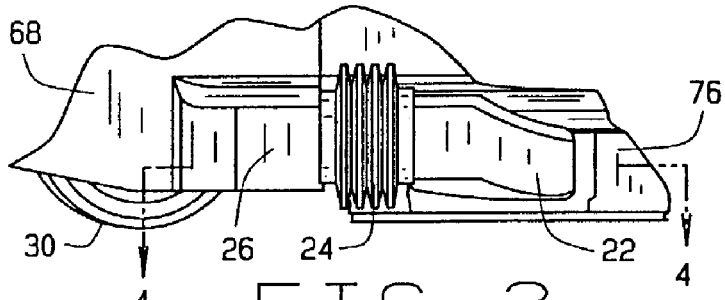
FIG. 3 is an enlarged elevation view of a portion of the cleaning machine of FIG. 1 including the scoop, the boot and a portion of the throat.

FIG. 3 is an enlarged elevation view of a portion of the cleaning machine of FIG. 1 including the floating scoop 22, the flexible boot 24 and a portion of the throat 26. A wheel 30 supports the floor cleaning machine 10 and facilitates movement of the floor cleaning machine 10 when not in operation. The floating scoop 22 is connected to the hoop 76 so the floating scoop 22 and the hoop 76 float up and down in tandem. The throat 26 is arranged generally tangentially to the containment canister 28. The flexible boot 24 allows the floating scoop 22 to attach to the non-floating throat 26. It is not necessary that the throat 26 be rigidly connected to the floor cleaning machine 10. All that is necessary is for the floating scoop 22 and the throat 26 to be in communication with the housing 18 on one end. The containment canister 28 is circular and holds the removable filter 56.

Figure 4:
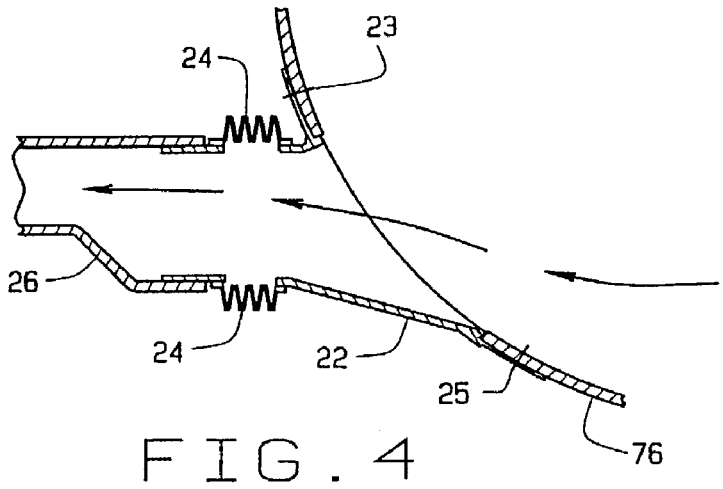
FIG. 4 is a section view, taken along the line 4—4 of FIG. 3, showing the scoop, the boot and a portion of the throat.

FIG. 4 is a section view along the line 4—4 of FIG. 3 showing the flow path through the floating scoop 22, the boot 24 and the throat 26 as shown by the flow arrows. The floating scoop 22 is connected to the hoop by the fasteners 23 and 25. The floating scoop 22 acts as an outlet for air and entrained particles (dust) leaving the housing 22.

Figure 5:
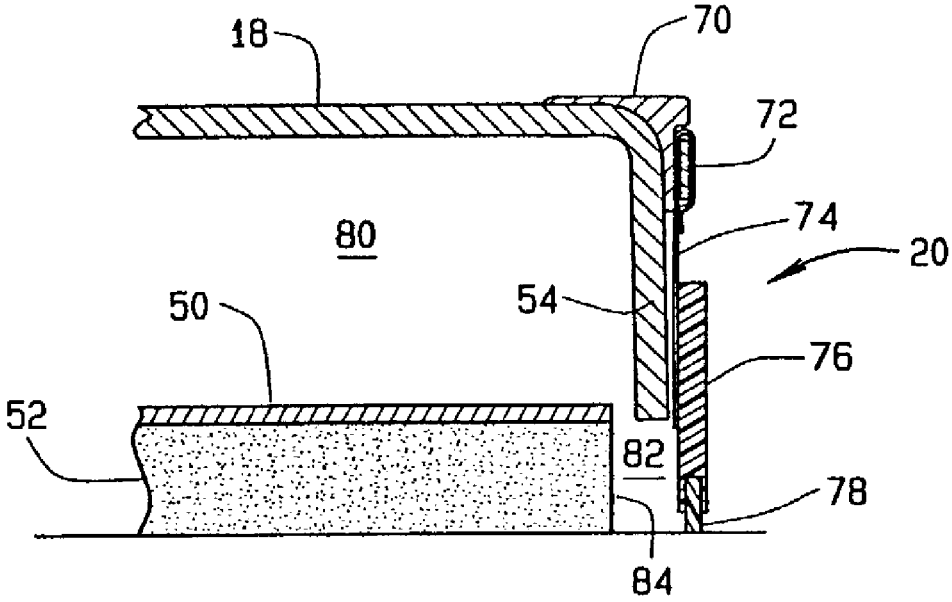
FIG. 5 is a section view, taken along the line 5—5 of FIG. 2, showing portions of the housing, the pad driver, the pad and the floating hoop assembly. The pad in FIG. 5 is new and the floating hoop assembly is fully extended to accommodate the full height of the new pad.

FIG. 5 is a section view, taken along the line 5—5 of FIG. 2, showing portions of the housing 18, the pad driver 50, the pad 52 and the floating hoop assembly generally identified by the numeral 20. The housing 18 includes a vertical sidewall 54, which surrounds the pad 52 and the pad driver 50. A bumper 70 is positioned about the outer edge of the housing 18. The floating hoop assembly 20 includes a clamp 72, a flexible nylon skirt 74, the circular hoop 76 and the felt follower 78. The clamp 72 attaches the skirt 74 to the bumper 70 and the housing 18. The skirt 74 can be formed from Nylon, or other flexible material such as but not limited to canvas.

The floating hoop assembly 20 is fully extended because the pad 52 is new and has not yet been worn down by operations. The height of the pad 52 may vary as much as Â¼ inch due to wear. The housing 18, the sidewall 54 and the pad driver 50 define an upper flow passageway 80, only a portion of which is shown in this drawing. The upper flow passageway 80 includes all of the area between the pad driver 50 and the housing surrounded by the sidewall 54. Ambient air from outside the machine 10 enters the upper flow passageway 80 through the inlet 30, shown in FIG. 2. Due to the rotation of the pad 52, the air swirls around in a clockwise fashion in the upper flow passageway 80 and becomes entrained with particulate (dust).

A circumferential flow passageway 82 is generally defined by an outer edge 84 of the pad 52, the floating hoop assembly 20 and the floor. Air passing through the inlet 30 likewise passes into the circumferential flow passageway 82. Due to the rotation of the pad 52, the air swirls around in a clockwise fashion in the circumferential flow passageway 82 and becomes entrained with particulate (dust). The floating scoop 22 defines an outlet for the air and particulate (dust), the floating scoop 22 being in communication with both the upper flow passageway 80 and the circumferential flow passageway 82.

Figure 6:
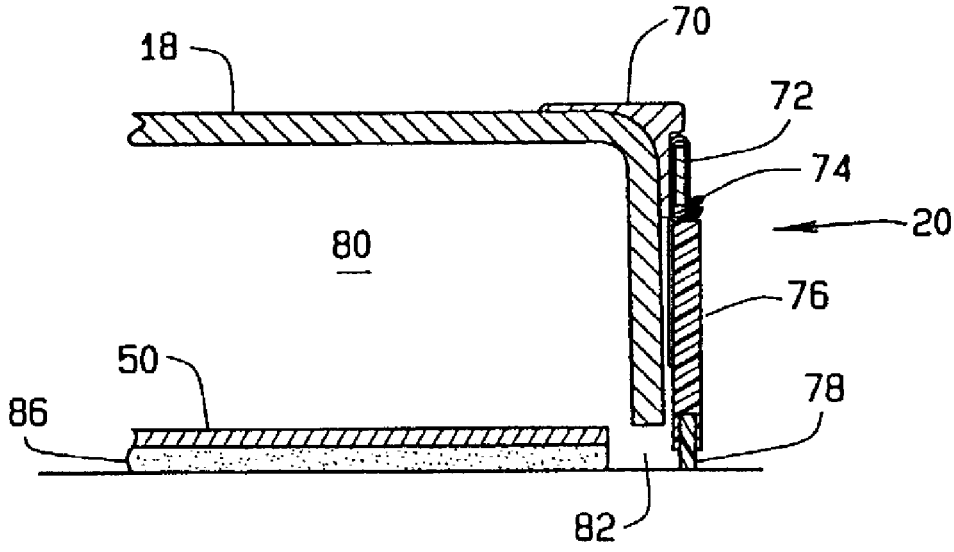
FIG. 6 is a section view, similar to FIG. 5, showing portions of the housing, the pad driver, the pad, and the floating hoop assembly, except the pad has been worn and is thinner than the new pad in FIG. 5. The floating hoop assembly in FIG. 6 is compressed because the worn pad is thinner than the new pad in FIG. 5.

FIG. 6 is a section view, similar to FIG. 5, showing portions of the housing 18, the pad driver 50 and the floating hoop assembly 20, except the pad has been worn and is thinner than the new pad 52 in FIG. 5. The worn pad is given a new numeral 86 to differentiate it from the new pad 52. The area of the circumferential passageway 82 decreases with wear of the pad 86. For this reason, it is important to have a scoop 22 that floats up and down with the hoop assembly 20. The scoops of the dust control apparatus in the Speed Star™ and the Revolution™ floor cleaning machines by Pioneer EclipseÂ® are filed in position and do not float up or down with pad wear.

Figure 7:
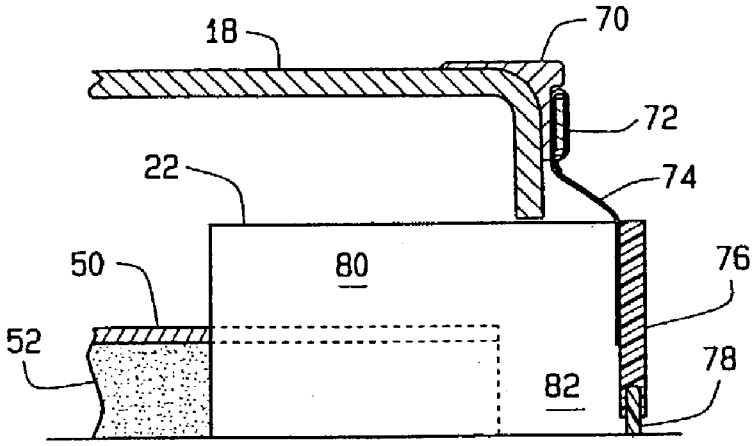
FIG. 7 is a section view of a portion of the housing, a portion of the pad and a portion of the floating hoop assembly showing the scoop in overlay. This figure shows that the scoop is in communication with the upper flow passageway and the circumferential flow passageway.

FIG. 7 is a section view of a portion of the housing 18, a portion of the pad 52 and a portion of the floating hoop assembly 20 showing the floating scoop 22 in overlay. This figure shows that the floating scoop 22 is in communication with the upper flow passageway. 80 and the circumferential flow passageway 82.

Figure 8:
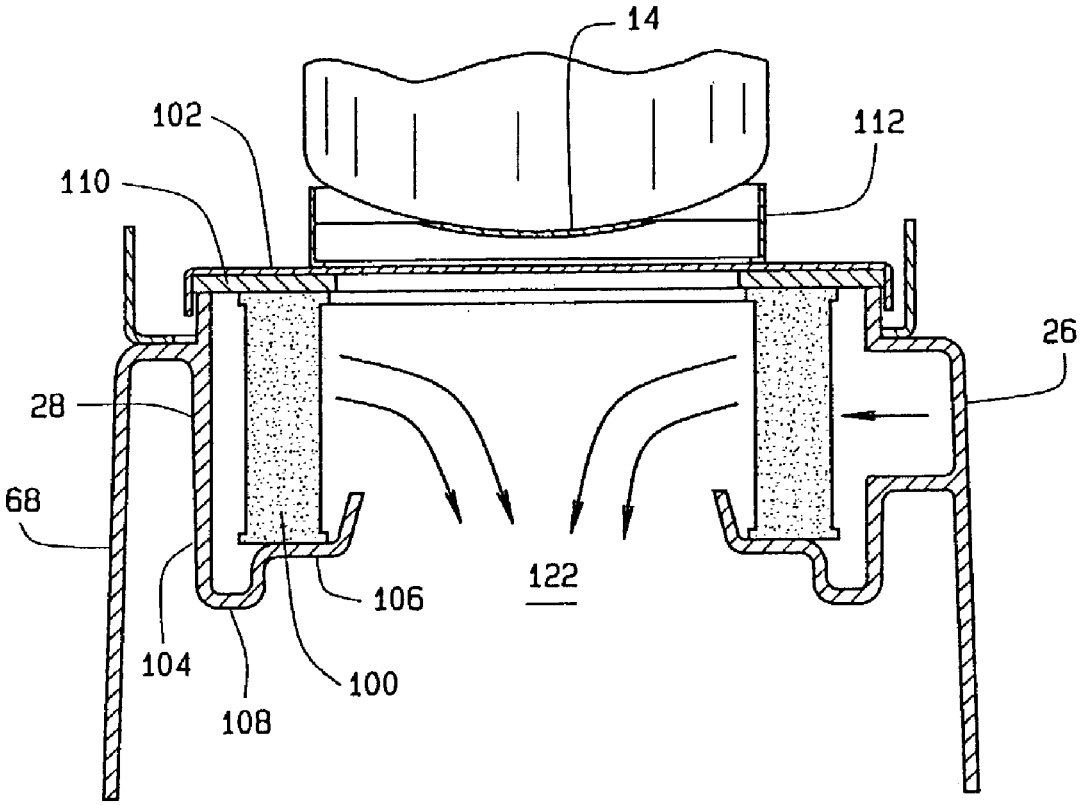
FIG. 8 is a section view, taken along the line 8—8 of FIG. 2, showing the circular containment canister and removable filter.

FIG. 8 is a section view, taken along the line 8—8 of FIG. 2, showing the circular container canister 28 and the removable filter 100. The canister 28 includes a lid 102, a circular wall 104, a shoulder 106 to support the filter 100, and a valley 108. A filter lid gasket 110 is positioned under the lid 102. The filter is sealed in the canister 28 by the gasket 10, the wall 104 and the shoulder 106. A propane bottle carrier 112 holds the propane tank 14.

Air and entrained particles (dust) enter the canister 28 through the throat 26 and swirl around the canister passageway 120, as better seen in FIG. 2. Heavier particles (dust) fall to the valley 108 as shown by the arrows in FIG. 8. This helps to enhance filter life. Air then passes through the filter 100 as indicated by the flow arrows. After passing through the filter 100, air is exhausted back to atmosphere through the outlet 122 as indicated by the flow arrows in FIG. 8.

To remove the filter, an operator first removes the propane tank 14 from the machine 10. The lid 102 is then opened and the filter 100 can be removed from the canister 28. The filter 100 can either be cleaned and replaced or a new filter 100 can be installed.

Although the preferred embodiment of the present invention has been described in the foregoing specification with considerable detail, it is to be understood that modifications may be made to the invention, which do not exceed the scope of the appended claims and modified forms of the present invention done by others skilled in the art to which the invention pertains will be considered infringements of this invention when those modified forms fall within the claimed scope of this invention.

The invention claimed is:

1. A floor cleaning machine with dust control apparatus, the floor cleaning machine creating dust as a by-product of normal operations, the floor cleaning machine comprising:
- an engine mounted on a frame supported by a wheel, the engine operatively connected to a rotatable pad driver that is capable of attaching a pad thereto, wherein the pad is capable of contacting a floor;
- a rigid housing surrounding the pad driver and pad, the housing having a sidewall, which is substantially vertical;
- an air outlet in the sidewall located at least partially opposite the rotatable pad driver that receives radially projected dust;
- a dust collection mechanism to receive at least a portion of the dust from the air outlet via an air conduit; and
- a floating hoop assembly with a flexible skirt that extends from the sidewall of the rigid housing to a floating circular hoop and felt follower in contact with the floor to assist in containment of at least a portion of the dust created during operation of the floor cleaning machine.

2. The floor cleaning machine with dust control apparatus of claim 1, wherein the dust collection mechanism includes a container mounted on the floor cleaning machine.

3. A floor cleaning machine with dust control apparatus, the floor cleaning machine creating dust as a by-product of normal operations, the floor cleaning machine comprising:
- an engine operatively connected to a rotatable pad driver that is capable of attaching a pad thereto, wherein the pad is capable of contacting a floor;
- a housing surrounding the pad driver and pad, the housing having a sidewall, which is substantially vertical;
- an air outlet in the sidewall located at least partially opposite the rotatable pad driver that receives radially projected dust;
- a dust collection mechanism to receive at least a portion of the dust from the air outlet via an air conduit;
- a floating hoop assembly that extends from the sidewall of the housing to the floor to assist in containment of at least a portion of the dust created during operation of the floor cleaning machine; and
- a floating scoop connected to a portion of the floating hoop assembly.

4. The floor cleaning machine with dust control apparatus of claim 3, further including a throat in fluid communication with the floating scoop to direct at least a portion of the dust away from the pad by creating a suction utilizing a venturi-effect.

5. A floor cleaning machine with dust control apparatus, the floor cleaning machine creating dust as a by-product of normal operations, the floor cleaning machine comprising:

an engine operatively connected to a rotatable pad driver that is capable of attaching a pad thereto, wherein the pad is capable of contacting a floor;

a housing surrounding the pad driver and pad, the housing having a sidewall;

a floating hoop assembly that extends from the sidewall of the housing to the floor to assist in containment of at least a portion of the dust created during operation of the floor cleaning machine;

a floating scoop connected to a portion of the floating hoop assembly, the scoop and the hoop assembly capable of moving up and down in tandem, the scoop directing at least a portion of the dust away from the pad;

a throat in fluid communication with the floating scoop to direct at least a portion of the dust away from the pad; and a circular canister mounted on the floor cleaning machine, the canister in communication with the throat to receive and assist in containment of at least a portion of the dust.

6. The floor cleaning machine with dust control apparatus of claim 5, further including a removable circular filter positioned in the canister to assist in containment of at least a portion of the dust.

7. The floor cleaning machine with dust control apparatus of claim 5, wherein an upper flow passageway is defined by the pad driver and the housing and a circumferential flow passageway is defined by an outer edge of the pad and the floating hoop assembly and the floor.

8. The floor cleaning machine with dust control apparatus of claim 7, wherein the sidewall of the housing further defines an air inlet to allow ambient air to pass from an outside of the housing into the upper flow passageway and wherein the floating scoop defines an outlet for the air and dust, the floating scoop being in communication with both the upper flow passageway and the circumferential flow passageway.

9. The floor cleaning machine with dust control apparatus of claim 8, wherein at least a portion of the floating scoop and outlet are positioned generally tangential to the circumferential flow passageway.

10. The floor cleaning machine with dust control apparatus of claim 8, wherein the canister is circular and the throat is positioned generally tangential to the canister causing the air and dust to swirl in a generally circular flow path in the canister to encourage at least a portion of the dust to fall to a valley in a bottom of the canister.

11. A dust control apparatus for use with a floor cleaning machine capable of utilizing a rotatable pad that can contact a floor and creates a stream of air and entrained particulate during normal operation, the rotatable pad is enclosed by a generally circular housing having a sidewall, the dust control apparatus comprising:

a floating hoop assembly that extends from the sidewall of the housing to the floor to assist in containment of the entrained particulate created during operation of the floor cleaning machine;

a floating scoop connected to a portion of the floating hoop assembly, the scoop and the hoop assembly moving up and down in tandem, the scoop directing at least a portion of the entrained particulate away from the pad;

a throat rigidly connected to the floor cleaning machine, the throat in communication with the floating scoop to direct at least a portion of the entrained particulate away from the pad;

a flexible boot connecting the floating scoop to the throat; and a separator with a removable filter mounted on the floor cleaning machine, the separator in communication with the throat to receive and assist in containment of the entrained particulate.

12. The dust control apparatus for use with a floor cleaning machine of claim 11, wherein the separator is generally circular and the throat is located generally tangential to the separator causing the stream of air and entrained particulate to circulate in a circular motion about the filter.

13. The dust control apparatus for use with a floor cleaning machine of claim 12, further including a valley in a bottom of the separator, the valley being located below the filter to provide a receptacle for particulate that separates from the stream of air.

14. An after-market dust control apparatus for attachment to a floor cleaning machine that creates dust during normal operations, the machine capable of utilizing a circular pad that contacts the floor and creates a positive air flow while the pad is rotated, the pad surrounded by a housing with a sidewall, the after-market dust control apparatus comprising:

a floating hoop assembly that extends from the sidewall of the housing to the floor to assist in containment of the dust created during operation of the floor cleaning machine a floating scoop connected to a portion of the floating hoop assembly that moves up and down in tandem with the hoop assembly, the scoop directing at least a portion of the dust away from the pad;

an attachment mechanism that connects the floating hoop assembly to the housing;

a throat in communication with the floating scoop to direct at least a portion of the dust away from the pad; and a containment canister connected to the floor cleaning machine, the canister in communication with the throat to receive and contain at least a portion of the dust.

15. The after-market dust control apparatus for attachment to a floor cleaning machine of claim 14, further including a removable filter positioned in the containment canister to assist in separation of the dust from the air flow created by the operation of the floor cleaning machine.

16. The after-market dust control apparatus for attachment to a floor cleaning machine of claim 15, wherein the containment canister is generally circular and the throat is located generally tangential to the containment canister causing the air and dust to swirl in a generally circular flow path in the containment canister to encourage the dust to fall to a valley in a bottom of the containment canister.

17. An after-market dust control apparatus for attachment to a floor cleaning machine having a pad driver that is capable of utilizing a rotatable pad that contacts the floor and creates a stream of air and entrained particulate during operations, the pad enclosed by a generally circular housing with a sidewall, the after-market dust control apparatus comprising:

a floating hoop assembly that extends from the sidewall of the housing to the floor to contain at least a portion of the stream of air and entrained particulate created during operation of the floor cleaning machine;

a floating scoop connected to a portion of the floating hoop assembly, the scoop and the hoop assembly moving up and down in tandem, the scoop containing and directing at least a portion of the stream of air and entrained particulate away from the pad driver;

an attachment mechanism that connects the floating hoop assembly and floating scoop to the housing;

a throat containing and directing the stream of air and entrained particulate away from the pad driver; and a separator with a removable filter, the separator in communication with the throat to receive the stream of air and entrained particulate and separate at least a portion of the particulate from the air.

18. The after-market dust control apparatus for attachment to a floor cleaning machine of claim 17, wherein the separator is generally circular and the throat is positioned generally tangential to the separator causing the air and dust to swirl in a generally circular flow path in the separator to encourage the dust to fall to a valley in a bottom of the separator.

19. A propane-powered burnisher with dust control apparatus, the propane-powered burnisher creating dust as a by-product of normal operations, the propane-powered burnisher comprising:

a propane-powered engine operatively connected by a belt to a rotating pad driver and rotating pad in contact with the floor;

a housing surrounding the pad driver and pad, the housing having a top and a sidewall;

a floating hoop assembly that extends from the sidewall of the housing to the floor to assist in containment of at least a portion of the dust created during operation of the propane-powered burnisher;

a floating scoop connected to the floating hoop assembly, the scoop and the hoop assembly moving up and down in tandem, the scoop directing at least a portion of the dust away from the pad;

a throat rigidly connected to the propane-powered burnisher, the throat in communication with the floating scoop to direct at least a portion of the dust away from the pad;

a flexible boot connecting the floating scoop to the non-floating throat;

a circular canister mounted on the propane-powered burnisher, the canister in communication with the throat to receive and assist in containment of the dust;

an upper flow passageway defined by the pad driver and the top and sidewall of the housing;

a circumferential flow passageway defined by an outer edge of the pad and a portion of the floating hoop assembly;

an inlet formed in the sidewall of the housing to allow ambient air to pass from an outside of the housing into the upper flow passageway; and an outlet formed in the scoop for the air and dust, the outlet being in communication with both the upper flow passageway and the circumferential flow passageway.

20. The propane-powered burnisher with dust control apparatus of claim 19, further including: a removable filter positioned in the canister to assist in containment of the dust created by operation of the burnisher.

21. The apparatus of claim 19, wherein the canister is generally circular and the throat is located generally tangential to the canister causing the air and dust to swirl in a generally circular flow path in the canister to encourage at least a portion of the dust to fall to a valley in a bottom of the canister.

22. A method for utilizing a floor cleaning machine that creates dust as a by-product of normal operations with dust control apparatus, the method comprising:

rotating a pad driver with an engine rigidly mounted on a frame, wherein the pad driver is capable of attaching a pad thereto, wherein the pad is capable of contacting a floor; removing air, having radially projected dust, through an air outlet located in a sidewall, which is substantially vertical, from a rigid housing surrounding the pad driver and pad, wherein the air outlet in the sidewall is located at least partially opposite the rotatable pad driver;

containing air and dust with a floating hoop assembly with a flexible skirt that extends from the sidewall of the rigid housing to a floating circular hoop and felt follower in contact with the floor to assist in containment of at least a portion of the dust created during operation of the floor cleaning machine; and conveying at least a portion of the dust from the air outlet via an air conduit to a dust collection mechanism.

* * * * *

UNITED STATES PATENT AND TRADEMARK OFFICE

CERTIFICATE OF CORRECTION

PATENT NO. : 7,162,771 B2
APPLICATION NO. : 10/249741
DATED : January 16, 2007
INVENTOR(S) : Scott F. Grosze It is certified that error appears in the above-identified patent and that said Letters Patent is hereby corrected as shown below:

Col. 8, line 47, delete "contaimnent" and replace with -- containment --

Col. 8, line 52, delete "contaimnent" and replace with -- containment --

Col. 10, line 32, delete "a rigid housing" and replace with -- a housing --

Col. 10, line 37, delete "assembly with a flexible skirt that" and replace with -- assembly that --

Col. 10, line 37 delete "sidewall of the" and replace with -- sidewall of a --

Col. 10, line 38 delete "to a floating circular hoop and felt follower in contact with the floor to" and replace with -- to the floor with a flexible skirt to --

Signed and Sealed this

Twenty-fourth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,162,771 B2
APPLICATION NO. : 10/249741
DATED : January 16, 2007
INVENTOR(S) : Scott F. Grosze It is certified that error appears in the above-identified patent and that said Letters Patent is hereby corrected as shown below:

Col. 2, line 4, delete "1Â1/2" and replace with --$1^{1/2}$ --

Col. 2, line 31, delete "Â1/2" and replace with -- 1/4 --

Col. 2, line 56, delete "Speed StartÂ□" and replace with -- Speed Start™ --

Col. 2, line 56, delete "RevolutionÂ□" and replace with -- Revolution™ --

Col. 2, line 56, delete "EclipseÂ®" and replace with -- Eclipse® --

Col. 5, line 18, delete "Â1/4" and replace with -- 1/4 --

Col. 8, line 47, delete "contaimnent" and replace with -- containment --

Col. 8, line 52, delete "contaimnent" and replace with -- containment --

Signed and Sealed this

Fifth Day of June, 2007

JON W. DUDAS
*Director of the United States Patent and Trademark Office*